US012516499B1

(12) United States Patent
Phadtare et al.

(10) Patent No.: US 12,516,499 B1
(45) Date of Patent: Jan. 6, 2026

(54) SYSTEM AND METHOD FOR PREDICTIVELY MITIGATING THE IMPACTS OF TRAVEL ACROSS UNEVEN TERRAIN BY A WORK MACHINE

(71) Applicant: Deere & Company, Moline, IL (US)

(72) Inventors: Amol Balasaheb Phadtare, Pune (IN); Piyush Ainapure, Pune (IN); Balkrishna R. Joshilkar, Pune (IN)

(73) Assignee: Deere & Company, Moline, IL (US)

( * ) Notice: Subject to any disclaimer, the term of this patent is extended or adjusted under 35 U.S.C. 154(b) by 52 days.

(21) Appl. No.: 18/752,919

(22) Filed: Jun. 25, 2024

(51) Int. Cl.
*E02F 9/20* (2006.01)

(52) U.S. Cl.
CPC ..... *E02F 9/2025* (2013.01)

(58) Field of Classification Search
CPC ..... E02F 9/2025
See application file for complete search history.

(56) References Cited

U.S. PATENT DOCUMENTS

| | | | | |
|---|---|---|---|---|
| 4,953,723 | A | 9/1990 | Saotome et al. | |
| 5,147,472 | A | 9/1992 | Reichgott | |
| 5,520,499 | A | 5/1996 | Ufheil et al. | |
| 6,108,949 | A * | 8/2000 | Singh | E02F 3/437 701/50 |
| 6,766,236 | B1 | 7/2004 | Lamela et al. | |
| 7,722,056 | B2 | 5/2010 | Inoue et al. | |
| 7,949,449 | B2 | 5/2011 | Koch et al. | |
| 9,803,336 | B2 * | 10/2017 | Wei | E02F 3/842 |
| 10,246,854 | B2 | 4/2019 | Greer | |
| 10,875,589 | B2 | 12/2020 | Letscher et al. | |
| 10,975,546 | B2 * | 4/2021 | Wei | E02F 9/262 |
| 11,118,453 | B2 * | 9/2021 | Wei | E02F 9/262 |
| 11,401,692 | B2 | 8/2022 | Rannow et al. | |
| 11,459,734 | B2 * | 10/2022 | Takaoka | E02F 3/845 |
| 11,578,470 | B2 * | 2/2023 | Harada | E02F 9/205 |
| 2005/0275184 | A1 | 12/2005 | Lamela et al. | |
| 2009/0079145 | A1 | 3/2009 | Inoue et al. | |

(Continued)

FOREIGN PATENT DOCUMENTS

| | | | |
|---|---|---|---|
| DE | 102018217570 | A1 | 4/2020 |
| JP | 4525918 | B2 | 8/2010 |

(Continued)

*Primary Examiner* — Tyler J Lee
(74) *Attorney, Agent, or Firm* — Gary L. Montle; Lucian Wayne Beavers; Patterson Intellectual Property Law, PC

(57) ABSTRACT

Systems and methods are provided for predictively mitigating the impacts of travel across uneven terrain by a work machine having an implement for carrying load and capable of movement relative to the work machine frame. During a current operation, inputs are collected from perception sensors corresponding to terrain characteristics in at least a forward travel direction, from position sensors corresponding to a current position of the work implement relative to the work machine frame, and from load sensors corresponding to characteristics of a current load being carried by the work implement. Based on the various inputs, one or more impacts are predicted to result from travel across the terrain, and one or more work machine operating values are dynamically controlled during travel by the work machine across the terrain based at least on the predicted one or more impacts.

20 Claims, 6 Drawing Sheets

(56) References Cited

U.S. PATENT DOCUMENTS

| | | | | |
|---|---|---|---|---|
| 2014/0039767 | A1* | 2/2014 | Jensen | B60K 23/0808 701/50 |
| 2014/0039772 | A1* | 2/2014 | Jensen | B60K 23/0808 701/69 |
| 2014/0158452 | A1 | 6/2014 | Bowman et al. | |
| 2014/0277957 | A1* | 9/2014 | Clar | E02F 5/32 701/50 |
| 2015/0308078 | A1 | 10/2015 | Lee et al. | |
| 2016/0040388 | A1* | 2/2016 | Kontz | E02F 9/2045 701/50 |
| 2016/0153175 | A1 | 6/2016 | Wei et al. | |
| 2016/0343095 | A1* | 11/2016 | Wei | G06Q 10/06398 |
| 2017/0037593 | A1 | 2/2017 | Naik et al. | |
| 2017/0081826 | A1 | 3/2017 | Ferracin et al. | |
| 2017/0138016 | A1* | 5/2017 | Wei | E02F 9/205 |
| 2022/0282460 | A1 | 9/2022 | Oglesby et al. | |
| 2025/0059725 | A1* | 2/2025 | Kotani | E02F 9/262 |
| 2025/0092641 | A1* | 3/2025 | Rousell | G09B 19/16 |

FOREIGN PATENT DOCUMENTS

| | | | |
|---|---|---|---|
| WO | 2014166331 | A1 | 10/2014 |
| WO | 2018021321 | A1 | 2/2018 |

* cited by examiner

SYSTEM AND METHOD FOR PREDICTIVELY MITIGATING THE IMPACTS OF TRAVEL ACROSS UNEVEN TERRAIN BY A WORK MACHINE

FIELD OF THE DISCLOSURE

The present disclosure relates to work machines having work implements for carrying material and capable of movement relative to a frame thereof. More particularly, the present disclosure relates to systems and methods for automatically predicting the impacts of traverse over uneven terrain by the work machine, and dynamically controlling one or more work machine operating parameters to mitigate these impacts.

BACKGROUND

Work machines as discussed herein relate primarily to skid steer loaders, compact track loaders, four-wheel drive loaders, or other equivalent load-carrying machines for reasons as further described below, but may in various embodiments apply as well to other work machines which may travel across rough or otherwise uneven terrain during operation.

When such work machines travel over rough terrain, the riding condition for an operator of the work machine, or the carrying condition for material being carried by a work implement thereof (e.g., a bucket), is also rough due to forces acting on the work machine which create shocks. In addition to the relative discomfort experienced by the operator and corresponding effects on productivity, these shocks may cause material to spill out of bucket due to this rough ride, and/or material density may be loosened, either of which ultimately further impacts productivity.

For many such work machines, these forces may result where fluid in cylinders, for example as actuators for movement of the corresponding work implements, cause the cylinders to act as rigid members.

It would accordingly be desirable to improve upon existing ride control systems with system optimization for more inputs to control ride control functions, preferably to provide consistent performance in all terrains and speeds.

BRIEF SUMMARY OF THE DISCLOSURE

The current disclosure provides an enhancement to conventional systems, at least in part by enabling a ride control system and method through software and corresponding automated functions on a work machine, in various embodiments as implemented further in view of back-end models iteratively developed for retrieval by the work machine, further utilizing various sensors (e.g., perception sensors) already provided on the work machine and preferably limiting dependency on supplemental components.

Such a system and method as disclosed herein may enable ride control functions that desirably provide consistent performance in substantially any type of terrain and/or advance speed of the work machine.

In an embodiment, a method is disclosed herein for predictively mitigating the impacts of travel across uneven terrain by a work machine having at least one ground engaging mechanism and at least one implement configured to carry a load and movable across a range of positions relative to a frame of the work machine. During an iterative model development stage, first input data sets corresponding to one or more terrain characteristics and to one or more work machine operating values are correlated with further input data sets corresponding to one or more observed impacts, wherein the one or more work machine operating values comprise a work implement position, and wherein the one or more observed impacts comprise a detected vibration and/or a detected change in one or more load characteristics. During a current operation, input signals are received from one or more perception sensors corresponding to one or more terrain characteristics in at least a forward direction relative to the work machine, from one or more position sensors corresponding to a current position of the at least one work implement relative to the work machine frame, and from one or more load sensors corresponding to one or more characteristics of a current load being carried by the at least one work implement. The method further includes predicting one or more impacts to result from travel across the terrain in the at least forward direction, based on the received input signals during the current operation and the correlated one or more observed impacts as retrieved from the model, and dynamically controlling one or more work machine operating values during travel by the work machine across the terrain based at least on the predicted one or more impacts.

In one exemplary aspect according to the above-referenced method embodiment, the dynamically controlled one or more work machine operating values may comprise a position of the at least one work implement relative to the frame of the work machine.

In another exemplary aspect according to the above-referenced method embodiment, and optionally further according to other aspects as referenced herein, the dynamically controlled one or more work machine operating values may comprise a travel speed of the work machine.

In another exemplary aspect according to the above-referenced method embodiment, and optionally further according to other aspects as referenced herein, the method may comprise receiving input signals during the current operation corresponding to a current location of the work machine, and predicting the one or more impacts further based on previously mapped terrain characteristics associated with the current location of the work machine.

In another exemplary aspect according to the above-referenced method embodiment, and optionally further according to other aspects as referenced herein, the method may comprise automatically enabling the predicting of the one or more impacts and the dynamically controlling of the one or more work machine operating values based on a determination that a threshold load is exceeded via the one or more characteristics of the current load, and further based on a determination that the work machine is traveling.

In another exemplary aspect according to the above-referenced method embodiment, and optionally further according to other aspects as referenced herein, the method may comprise automatically disabling the predicting of the one or more impacts and the dynamically controlling of the one or more work machine operating values based on a determination that the at least one work implement is unloaded, or that the work machine is stopped.

In another exemplary aspect according to the above-referenced method embodiment, and optionally further according to other aspects as referenced herein, the one or more characteristics of the current load may comprise a total mass, a total volume, and/or a type of material being carried by the at least one work implement.

In another exemplary aspect according to the above-referenced method embodiment, and optionally further according to other aspects as referenced herein, the method may comprise, during the current operation, receiving the input signals from the one or more perception sensors further corresponding to one or more terrain characteristics in one or more buffer zones relative to the at least forward direction, and further predicting one or more impacts to result from travel across the terrain via the one or more buffer zones.

The dynamically controlled one or more work machine operating values during travel by the work machine across the terrain may further correspond to steering along a selectively modified path of the work machine via at least one of the one or more buffer zones based at least on the predicted one or more impacts.

In another exemplary aspect according to the above-referenced method embodiment, and optionally further according to other aspects as referenced herein, the one or more work machine operating values may be dynamically controlled to target values set according to a selected optimization mode from a plurality of selectable optimization modes.

At least one of the plurality of optimization modes may for example be configured to minimize vibration associated with the machine frame responsive to predicted impacts while remaining within a specified range of values for one or more other work conditions.

At least one of the plurality of optimization modes may as another example be configured to maximize values for one or more other work conditions while remaining within a specified range of values for vibration associated with the machine frame.

In another exemplary embodiment as disclosed herein, a computer-implemented system is provided for predictively reducing the impacts of travel across uneven terrain by a work machine having at least one ground engaging mechanism and at least one implement configured to carry a load and movable across a range of positions relative to a frame of the work machine, the system comprising one or more processors configured to direct the performance of steps in the above-referenced method embodiment and optionally one or more of the described aspects thereof.

In one exemplary aspect according to the above-referenced system embodiment, at least one of the one or more processors comprises a remote server functionally linked to a controller of the work machine comprising another of the one or more processors.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
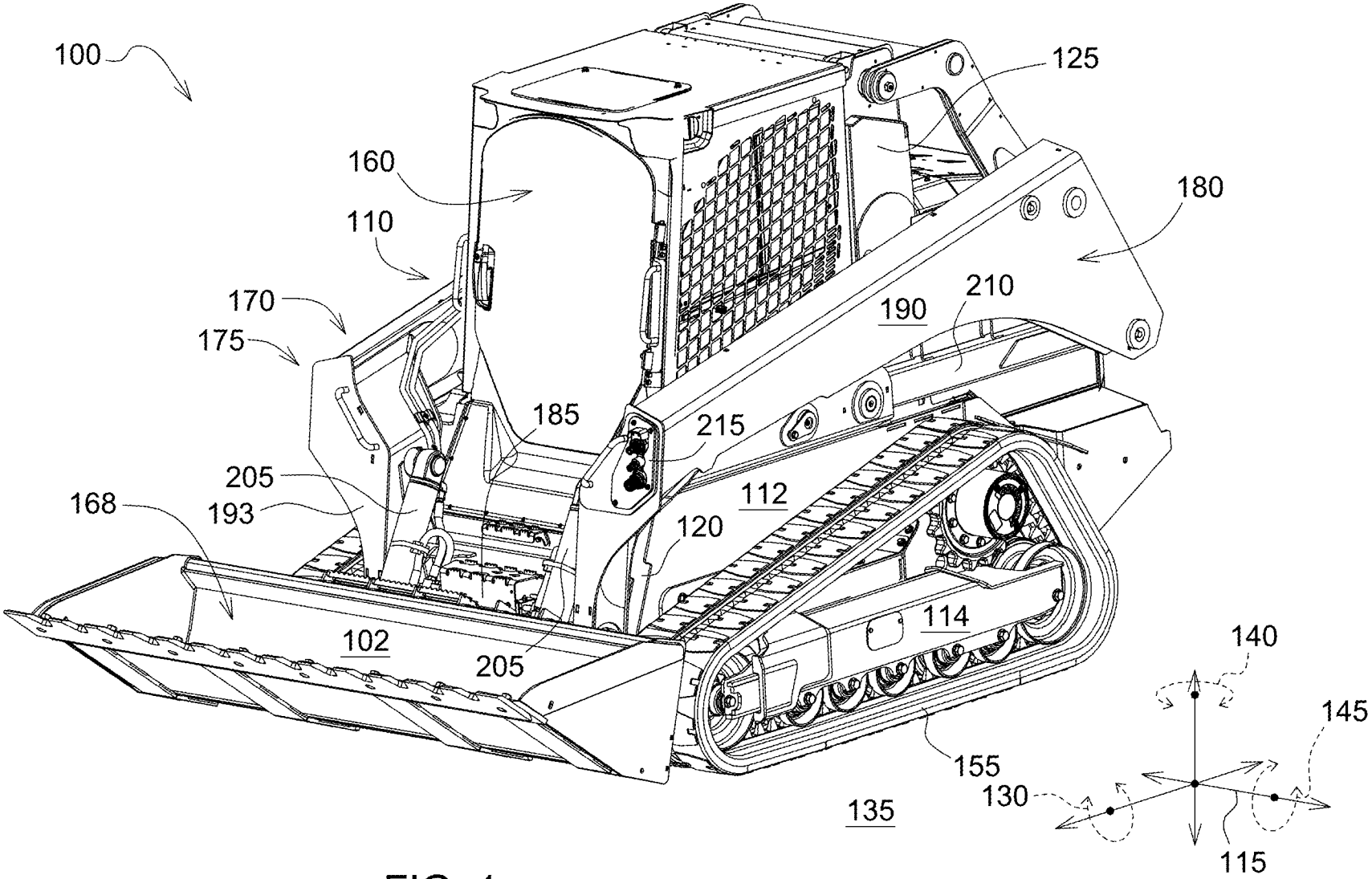
FIG. 1 is a perspective view of a skid-steer loader as an embodiment of a work machine according to the present disclosure.
Figure 2:
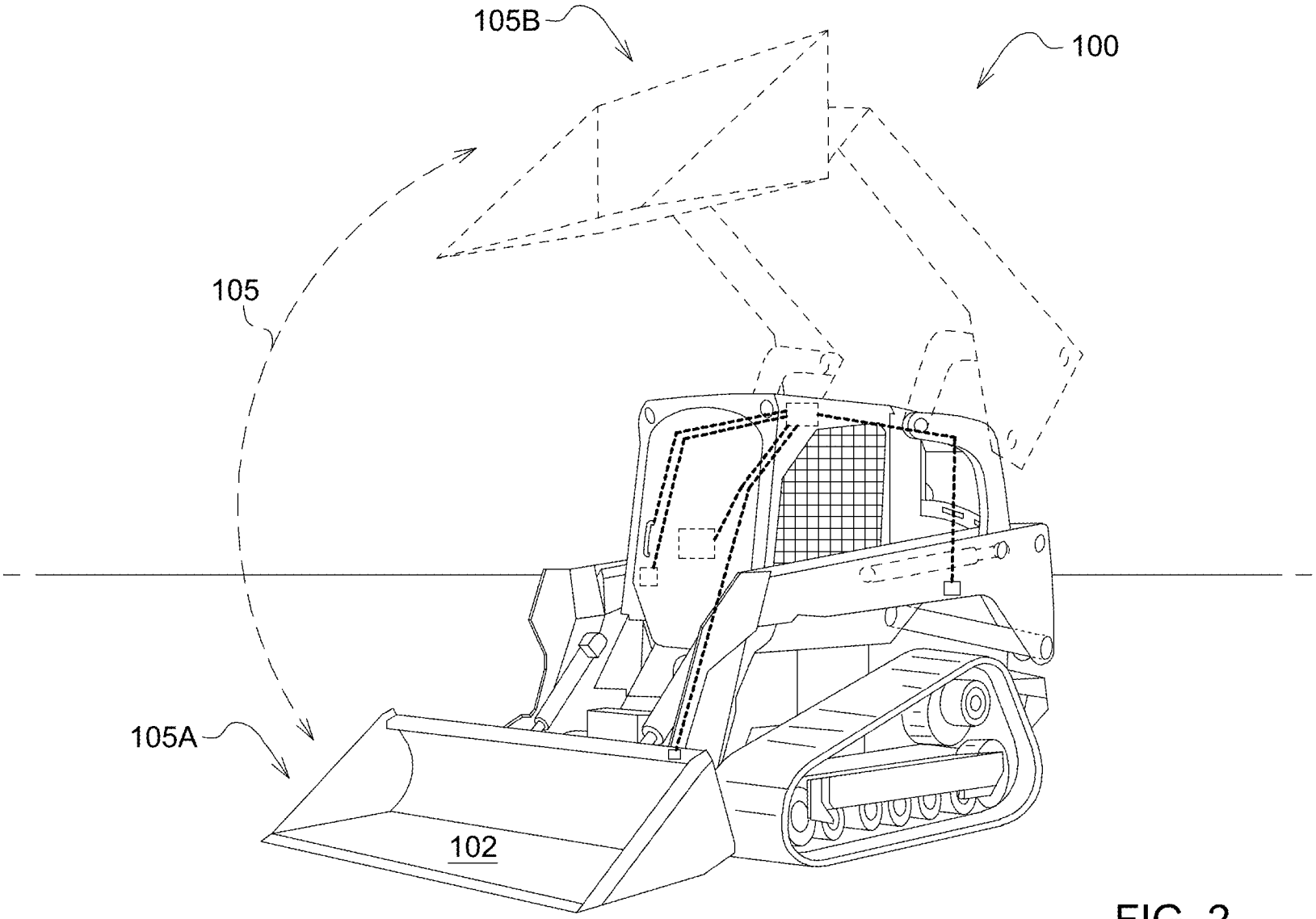
FIG. 2 is a perspective view of the skid-steer loader of FIG. 1 with the work implement moved between fully lowered and raised positions.

Referring now to the drawings and particularly to FIGS. 1 and 2, a representative work machine is shown and generally designated by the number 100. It may be understood that the work machine 100 could be one of many types of work machines, including, and without limitation, a skid steer loader, a four wheel drive (4WD) loader, an excavator, a backhoe loader, a bulldozer, and other construction vehicles, having distinctions in their respective components and as may be appreciated by one of skill in the art. The work machine 100, as shown, has a frame 110 extending in a fore-aft direction 115 with a front-end section 120 and a rear-end section 125. The work machine includes a ground-engaging mechanism 155 that supports the frame 110 and an operator cab 160 supported on the frame 110, wherein the ground-engaging mechanism 155 is configured to support the frame 110 on a surface 135.

An engine (not shown) may be coupled to the frame 110 and operable to move the work machine 100. The illustrated work machine 100 includes tracks as the ground engaging mechanism 155, but other embodiments can include one or more wheels that engage the surface 135. The work machine 100 may be operated to engage the surface 135 and cut and move material to achieve simple or complex features on the surface.

As used herein, directions with regard to work machine 100 may be referred to from the perspective of an operator seated within the operator cab 160; the left of work machine 100 is to the left of such an operator, the right of work machine is to the right of such an operator, the front or fore of work machine is the direction such an operator faces, the rear or aft of work machine is behind such an operator, the top of work machine is above such an operator, and the bottom of work machine below such an operator. In order to turn, the ground-engaging mechanism 155 on the left side of the work machine may be operated at a different speed, or in a different direction, from the ground-engaging mechanism 155 on the right side of the work machine 100. In a conventional track loader, the operator can manipulate controls from inside an operator cab 160 to drive the tracks on the right or left side of the work machine 100. Rotation for work machine may be referred to as roll 130 or the roll direction, pitch 145 or the pitch direction, and yaw 140 or the yaw direction.

A user interface 306 (further represented in FIG. 4) may be located within the operator cab 160 for use by an operator of the work machine 100. The user interface 306 may include or otherwise be functionally linked to one or more corresponding user interface tools 308 for input and/or output with respect to a controller 302 as further described below. Such user interface tools 308 may for example include a plurality of user selectable touch buttons (e.g., soft buttons), to select from a plurality of commands or menus, each of which may be selectable through a touch screen having a display unit 310. Touch buttons respond to touch and do not include a mechanical component requiring a force sufficient to engage mechanical features. The touch screen may be a graphical user interface configured to display icons as well as content of work machine applications. The display unit 310 may be configured to display in the touch screen still images, moving images, and video content through one or more different types of displays. The display unit 310 may include, but is not limited, to cathode ray tube (CRT) displays, light-emitting diode (LED) displays, and liquid crystal displays (LCD).

Such an onboard user interface 306 may be provided as part of or otherwise functionally linked to a vehicle control system 300 via for example a CAN bus arrangement or other equivalent forms of electrical and/or electro-mechanical signal transmission. Another form of user interface (not shown) may take the form of a display unit that is generated on a remote (i.e., not onboard) computing device, which may display outputs such as status indications and/or otherwise enable user interaction such as the providing of inputs to the system. In the context of a remote user interface, data transmission between for example the vehicle control system 300 and the user interface may take the form of a wireless communications system and associated components as are conventionally known in the art.

The user interface 306 may further include, or as may be as separately defined with respect to operator-accessible interface tools, an accelerator pedal which enables the operator to adjust the speed of the vehicle. In other embodiments, a hand lever provides this function. Other exemplary tools residing in or otherwise accessible from the operator cab 160 may include a steering wheel, a plurality of operator selectable touch buttons configured to enable the operator to control the operation and function of the work machine 100, and any accessories or implements being driven by the powertrain of the work machine, including for example the work implement 102.

The work machine 100 comprises a boom assembly 170 coupled to the frame 110. A work implement 102, for example including one or more work tools at a ground engaging end thereof, may be pivotally coupled at a forward portion 175 of the boom assembly 170, while a rear portion 180 of the boom assembly 170 is pivotally coupled to the frame 110. The frame 110 as represented comprises a main frame 112 and a track frame 114. The work implement 102 is illustrated as comprising a bucket 168 for carrying material, but may further or alternatively be or comprise any number of work tools such as a blade, forks, an auger, a drill, or a hammer, just to name a few possibilities. The work implement 102 may be coupled to the boom assembly 170 through an attachment coupler 185 which may be coupled to a distal section of the lift arms 190, or more specifically a portion of the boom arms in the forward portion 175 of the boom assembly 170.

The boom assembly 170 comprises a first pair of lift arms 190 pivotally coupled to the frame 110 (one each on a left side and a right side of the operator cab 160) and moveable relative to the frame 110 by a pair of first hydraulic cylinders 200, wherein the pair of first hydraulic cylinders 200 may also conventionally be referred to as a pair of lift cylinders (one coupled to each boom arm). The attachment coupler 185 may be coupled to a forward section 193 of the pair of lift arms 190, being moveable relative to the frame 110 by a pair of second hydraulic cylinders 205, which may be referred to as tilt cylinders. The frame 110 of the work machine 100 further comprises a hydraulic coupler 210 on the front-end portion 120 of the work machine 100 to couple one or more auxiliary hydraulic cylinders (not shown) to drive movement of or actuate auxiliary functions of a work implement 102. The attachment coupler 185 enables the mechanical coupling of the work implement 102 to the frame 110. The hydraulic coupler 210, contrary to the attachment coupler 185, enables the hydraulic coupling of an auxiliary hydraulic cylinder(s) on the work implement 102 to a hydraulic (implement control) system of the work machine 100. It may be understood that not all work implements 102 will have one or more auxiliary hydraulic cylinders and therefore may not use the hydraulic coupler 210. In some embodiments, the hydraulic coupler 210 may open or close a grapple type work implement, or spin a roller brush type work implement.

Each of the pair of first hydraulic cylinders 200, the pair of second hydraulic cylinders 205, and any auxiliary cylinders if applicable when found on the work implement 102 may be double acting hydraulic cylinders. One end of each cylinder may be referred to as a head end, and the end of each cylinder opposite the head end may be referred to as a rod end. Each of the head end and the rod end may be fixedly coupled to another component, such as a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a moveable piston connected to a rod of the hydraulic cylinder. The volumes of each of the head chamber and the rod chamber change with movement of the piston, while movement of the piston results in extension or retraction of the hydraulic cylinder.

For a work machine 100 as represented in FIGS. 1 and 2, it may be appreciated that different potential positions 105 of the boom assembly 170 and more particularly the lift arms 190 thereof correspond to an available trajectory of movement between a fully lowered position 105A and a fully raised position 105B. In the fully lowered position 105A, for example, the work implement 102 may be set to a level position with the ground surface 135 such that a plane defined by a bottom portion of the bucket 168 is substantially flush with the ground and is substantially horizontal. However, under some conditions, the work implement 102 may be capable of being lowered further than the illustrated position 105A if for example the surface of the ground beneath the work implement 102 is lower than the surface of the ground engaging mechanisms 155 upon which the work machine 100 is located.

It may further be appreciated that a current position 105 of the work implement 102 influences a relative stability of the work machine 100 and associated travel and/or load carrying operations, further depending in part on a travel speed, terrain characteristics, etc.

Figure 3:
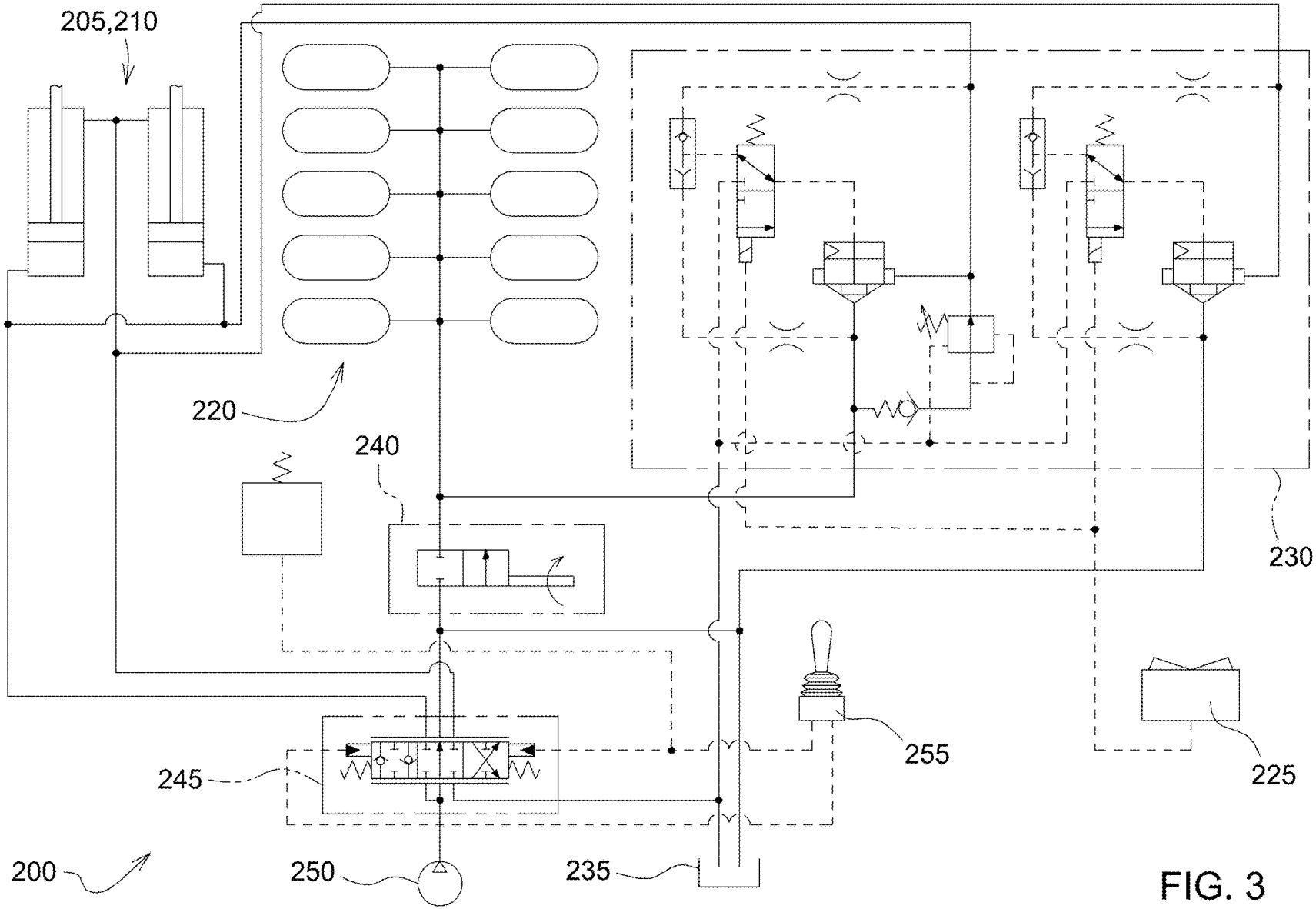
FIG. 3 is a graphical diagram representing aspects of an exemplary ride control system for a work machine of the present disclosure.

As schematically illustrated in FIG. 3, one example of a manually activated ride control system 200, or at least a portion thereof, includes cylinders 200, 205 and ride control valves 230 in combination with an accumulator 220. Also represented in this example are a hydraulic tank 235, safety valve, 240, main control valve 245, pump 250, and remote control lever 255. This ride control system 200 may be arranged to reduce or otherwise mitigate shocks by connecting the cylinders line to the accumulator 220 to absorb shocks when the ride control accumulator function is activated. However, this system cannot predict and fully eliminate shocks over all terrains, such that issues of material spillage remain. In addition, such a system relies on manual on/off selection using a ride control switch 225, and cannot be implemented using standard hardware configurations but further require the provision of extra components such as the ride control valve 230 and the accumulator 220.

Figure 4:
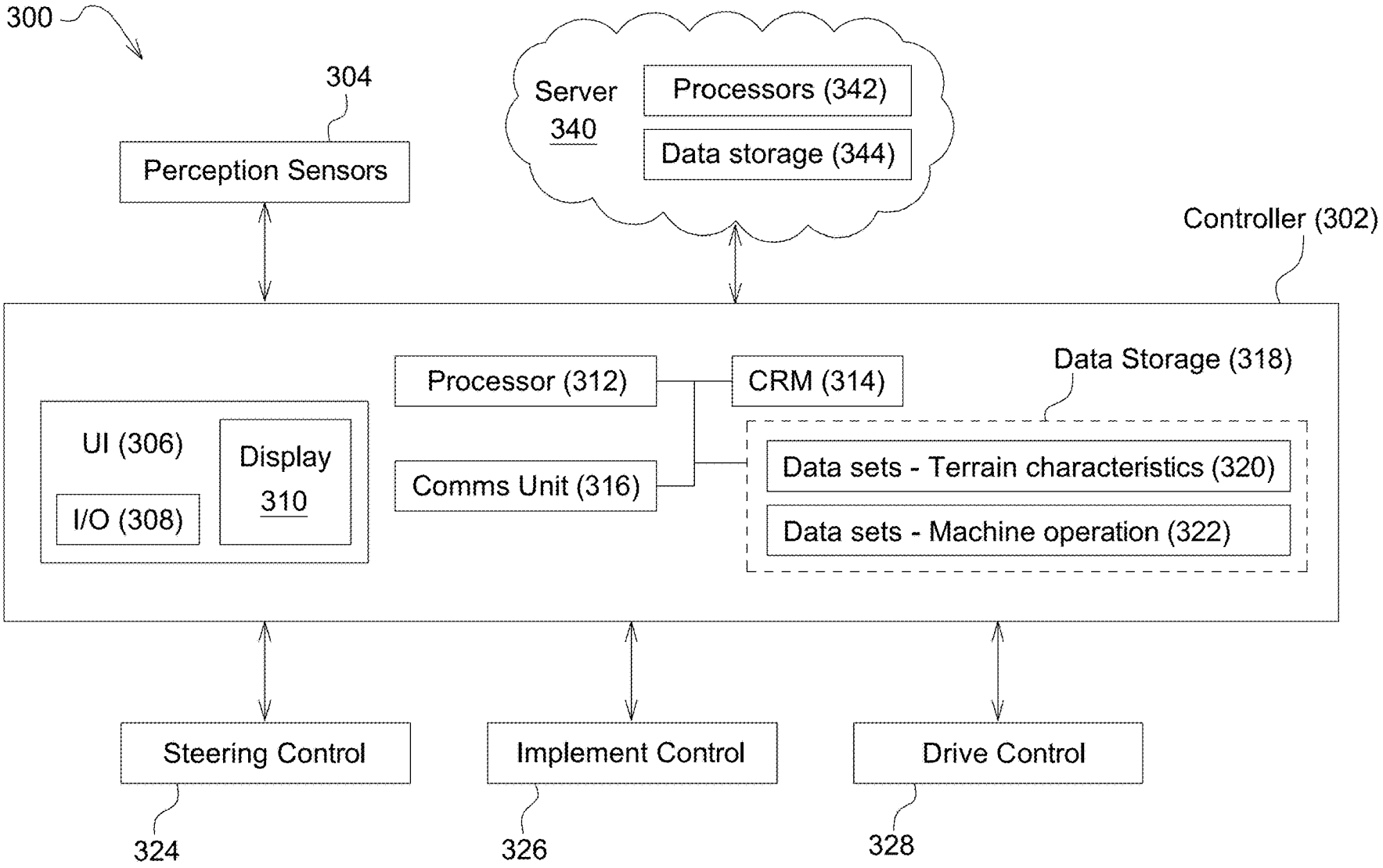
FIG. 4 is a graphical diagram representing aspects of an exemplary vehicle control system for a work machine of the present disclosure.

As schematically illustrated in FIG. 4, an embodiment of a predictive and automated ride control system 300 for a work machine 100 as disclosed herein includes a control system 300 including a controller 302. The controller 302 may be part of the vehicle control unit, or it may be a separate control module. The controller 302 may include the user interface 306 and optionally be mounted in the operator cab 160 at a control panel.

The controller 302 is configured to receive input signals from one or more perception sensors 304. The one or more perception sensors 304 may generally be configured to generate signals representative of aspects of the vehicle surroundings, optionally including but not limited to ground surface conditions, incline, cross-slope, stationary and/or moving obstacles, and the like. Perception sensors 304 may include imaging devices, the input signals from which may be provided directly to the controller 302 or for example via intervening components for analog-to-digital conversion and/or video interface (not shown).

Certain additional sensors (not shown) may be functionally linked to the controller 302 and provided to detect vehicle operating conditions and/or kinematics, and/or such inputs may be provided from a vehicle control system or the like.

In a particular exemplary embodiment, vehicle kinematics sensors for tracking a position of the work machine 100, work implement 102, and/or perception sensors 304 may be provided in the form of inertial measurement units (each, an IMU). IMUs include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU.

In another embodiment, non-kinematic sensors may be implemented for position detection, such as for example markers or other machine-readable components that are mounted or printed on the work machine 100 and within the field of view of an imaging device as a perception sensor 304. In one example, April tags or an equivalent may be provided such that, depending on how the marker appears within the field of view of the imaging device, data processing elements may calculate a distance to the marker and/or orientation of the marker relative to the imaging device 304 for spatially ascertaining the position of the imaging device. As another example, machine learning techniques may be implemented based on inputs for two or more known components of the work machine 100 such as a front cab mount and a rear mudguard, such that the data processing units can spatially ascertain a position of the imaging device based on a distance between the two or more components and their respective positions in the field of view of the imaging device.

Other sensors functionally linked to the controller 302 which may optionally be provided for functions as described herein or otherwise may include for example load pressure sensors, global navigation satellite system (GNSS) sensors, vehicle speed sensors, ultrasonic sensors, laser scanners, radar wave transmitters and receivers, thermal sensors, imaging devices, structured light sensors, and other optical sensors, and whereas one or more of these sensors may be discrete in nature a sensor system may further refer to signals provided from a central machine control unit.

An imaging device as a perception sensor 304 may include video cameras configured to record an original image stream and transmit corresponding data to the controller 302. In the alternative or in addition, exemplary perception sensors 304 may include one or more of a digital (CCD/CMOS) camera, an infrared camera, a stereoscopic camera, a PMD camera, high resolution light detection and ranging (LiDAR) scanners, radar detectors, laser scanners, and the like within the scope of the present disclosure. The number and orientation of said perception sensors 304 may vary in accordance with the type of work machine 100 and relevant applications, but may at least be provided with respect to a field of view configured to capture data associated with work machine surroundings and associated objects proximate thereto.

One of skill in the art may appreciate that image data processing functions may be performed discretely at a given imaging device if properly configured, but most if not all image data processing may generally be performed by the controller 302 or other downstream data processor. For example, image data or the equivalent from any one or more perception sensors 304 may be provided for three-dimensional point cloud generation, image segmentation, object delineation and classification, and the like, using data processing tools as are known in the art in combination with the objectives disclosed.

The controller 302 of the work machine 100 may be configured to produce outputs, as further described below, to a user interface 306 associated with a display unit 310 for display to the human operator. The controller 302 may be configured to receive inputs from the user interface 306, such as user input provided via the user interface 306. Not specifically represented in FIG. 4, the controller 302 of the work machine 100 may in some embodiments further receive inputs from and generate outputs to remote devices associated with a user via a respective user interface, for example a display unit with touchscreen interface. Data transmission between for example the vehicle control system and a remote user interface may take the form of a wireless communications system and associated components as are conventionally known in the art.

In an embodiment, a remote server 340 such as in the form of a cloud server environment may include one or more processors 342 functionally linked with data storage 344. The remote server 340 may include models as further described below in the data storage 344. In certain embodiments, a remote user interface and vehicle control systems for respective work machines may be further coordinated or otherwise interact with the remote server 340 or other computing device for the performance of operations in a system as disclosed herein.

The controller 302 may be configured to generate control signals for controlling the operation of respective actuators, or signals for indirect control via intermediate control units, associated with a machine steering control system 324, a machine implement control system 326, and/or a machine drive control system 328. The controller 302 may for example be electrically coupled to respective components of these and/or other systems by a wiring harness such that messages, commands, and electrical power may be transmitted between the controller 302 and the remainder of the work machine 100. The controller 302 may be coupled to other controllers, such as for example the engine control unit (ECU), through a controller area network (CAN) bus, and may then send and receive messages over the CAN bus to communicate with other components thereof.

For example, control signals may comprise a steering control signal or data message that defines a steering angle of the steering shaft, a braking control signal or data message that defines the amount of deceleration, hydraulic pressure, or braking friction to the applied to brakes, a propulsion control signal or data message that controls a throttle setting, a fuel flow, a fuel injection system, vehicular speed, or vehicular acceleration. Further, where the work machine 100 may be propelled by an electric drive or electric motor, the propulsion control signal may control or modulate electrical energy, electrical current, electrical voltage provided to an electric drive or motor. The control signals generally vary with time as necessary to track the path plan. The lines that interconnect the components of the system may comprise logical communication paths, physical communication paths, or both. Logical communication paths may comprise communications or links between software modules, instructions, or data, whereas physical communication paths may comprise transmission lines, data buses, or communication channels, to name non-limiting examples.

The steering control unit 324 may for example comprise or otherwise interact with an electrically controlled hydraulic steering system, an electrically driven rack and pinion steering, an Ackerman steering system, or another steering system. The drive control unit 328 may for example comprise or otherwise interact with an internal combustion engine, an internal combustion engine-electric hybrid system, an electric drive system, or the like.

The controller 302 may include or be associated with one or more processors 312, computer readable media 314, a communication unit 316, data storage 318 such as for example a database network, and the aforementioned user interface 306 or control panel 306 having a display 310. An input/output device 308, such as a keyboard, joystick or other user interface tool, is provided so that the human operator may input instructions to the controller. It is understood that the controller described herein may be a single controller having all of the described functionality, or it may include multiple controllers wherein the described functionality is distributed among the multiple controllers.

Various operations, steps or algorithms as described in connection with the controller 302 can be embodied directly in hardware, in a computer program product such as a software module executed by the processor 312, or in a combination of the two. The computer program product can reside in RAM memory, flash memory, ROM memory, EPROM memory, EEPROM memory, registers, hard disk, a removable disk, or any other form of computer-readable medium 314 known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" 312 as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit 316 may support or provide communications between the controller and external systems or devices, and/or support or provide communication interface with respect to internal components of the work machine. The communications unit may include wireless communication system components (e.g., via cellular modem, WiFi, Bluetooth or the like) and/or may include one or more wired communications terminals such as universal serial bus ports.

The data storage 318 in an embodiment may be configured to at least receive and store real-time and/or historical data sets regarding terrain characteristics 320 (e.g., corresponding to outputs from the perception sensors 304) and real-time and/or historical data sets regarding machine operating values 322 (e.g., corresponding to measured loads, work implement position, vehicle advance speed, etc.) in selectively retrievable form, for example as inputs for developing models as further described herein for correlating the input data sets with observed impacts. Data storage as discussed herein may, unless otherwise stated, generally encompass hardware such as volatile or non-volatile storage devices, drives, memory, or other storage media, as well as one or more databases residing thereon.

Figure 5:
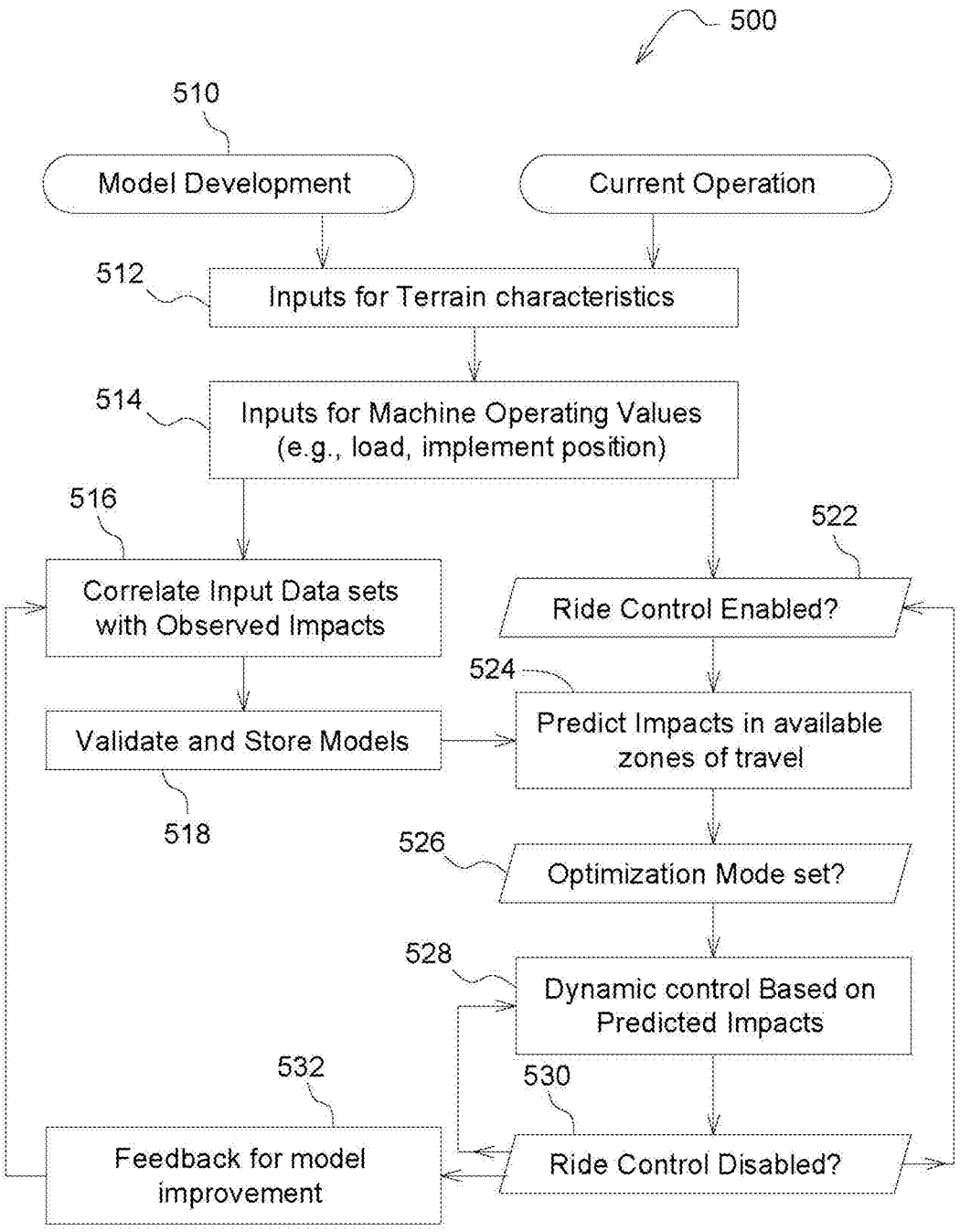
FIG. 5 is a flowchart representing an exemplary method according to the present disclosure.

Referring next to FIG. 5, the depicted flowchart represents an exemplary embodiment of a method 500 for operating a work machine 100, and more particularly for a ride control operation of a work machine 100. While the illustrated embodiment may include a specific arrangement of steps, inputs, outputs, and the like, it may be understood that certain steps may be combined, performed in a different order, or even omitted altogether in other embodiments within the scope of the present disclosure, unless otherwise specifically noted herein.

The method 500 may generally relate to a current operation of a work machine 100, but it may be understood that various steps of the current operation overlap with steps associated with a corresponding model development process 510, as for example inputs provided in steps 512 and 514, as well as feedback in step 532, may be provided for iterative development and potential improvement of the models, while in the context of the current operation.

Step 512 as depicted relates to the reception, collection, or otherwise obtaining of inputs relating to terrain characteristics. As noted above, the terrain characteristics may be provided based, directly or indirectly, on input signals from one or more perception sensors 304 associated with the work machine 100. Where certain terrain characteristics are indirectly obtained from the one or more perception sensors 304, this may include prediction of the certain terrain characteristics based on one or more directly measured values, such as for example the indirect prediction of soil compaction based on inputs from imaging devices, among other things.

In various embodiments, terrain characteristics may be determined at least in part based on previously mapped terrain characteristics associated with a current location of the work machine. For example, a first work machine may generate inputs for populating a digital map with location-specific terrain characteristics, which may then later be selectively retrieved and utilized by a second work machine (whether of the same type as the first work machine or otherwise) which may lack the perception sensors or other sensing elements but can merely utilize a global positioning system sensor to obtain the previously mapped values.

Exemplary terrain characteristics may include an orientation of the ground on which the work machine is, and will be, traveling, such as an incline, cross-slope, and changes therein.

Exemplary terrain characteristics may further include qualities of the material of the ground, such as for example a type of material, a condition of the material (e.g., wet or dry, soil compaction), a profile of the surface (e.g., corresponding to roughness), etc.

Step 514 as depicted relates to the reception, collection, or otherwise obtaining of inputs relating to machine operating values, such as for example load, work implement position, vehicle advance speed, and the like.

Step 516 as depicted relates, as part of the model development stage 510 of method 500, to the correlation of the input data sets obtained in steps 512 and 514 with observed impacts. Observed impacts may for example include any of various outcomes relevant to the ride control application, such as vibrations or shocks due to forces acting on the work machine, detected changes in load characteristics due to loss or disturbance of material carried by the work implement, and/or the like. Exemplary such observations may for example be provided manually (for example, via input from the user interface) and/or applied automatically in some embodiments using inputs corresponding or otherwise relevant to the type of impact from vibration sensors, load pressure sensors, etc.

In an embodiment, the model is developed to process and further predict impacts (e.g., shocks) acting upon work machine cylinders due to characteristics of the terrain being traversed, and further predict changes which can be made to one or more work machine operating settings for absorbing these shocks. As one example, calculations may become available with respect to boom cylinder movement that can absorb various degrees of shocks, depending in part on the current position of the boom and bucket relative to the frame of the work machine, the advance speed of the work machine, etc., and the model may accordingly enable not only prediction of the impacts but control of cylinder movement to absorb the impacts.

Step 518 as depicted in FIG. 5 relates, also as part of the model development stage 510 of method 500, to the validation and storage of the models, having been sufficiently developed using "test" input data sets and corresponding observed impacts such that they may be retrieved and utilized during subsequent operations for prediction based on "current" data sets. The current data sets may further (step 532) be utilized as feedback and accordingly a test dataset for further training and/or validation of the existing models.

In some embodiments, the models may include neural network-based models having variable governing parameters which are optimized during training to better simulate (or approximate in a particular simulation) observed real-life results corresponding to an input data set. Such parameters may initially be set (e.g., user-specified) before training. Tuning of the hyperparameters, or in other words optimizing the values there for, follows during training to obtain a set of values for the parameters corresponding to an accurate input-output mapping of the neural network for the training data set. In various embodiments, tuning of parameters may be performed automatically during or between training iterations, manually based on user selection via a user interface, or combinations thereof. In some embodiments the parameters are not initially user-specified but instead predetermined formulaically or otherwise according to a "best guess" distribution of possible simulation parameters, and in some embodiments may initially be unknown and merely derived during training. The parameters may for example determine aspects of the neural network structure and/or training parameters, such as the number of hidden neuron layers, number and/or definition of training steps, learning rates, batch size, and the like.

Returning to the context of a current operation, and upon obtaining the respective inputs in steps 512 and 514, the illustrative method 500 may include a step 522 of determining whether a ride control option has been enabled. For example, the system may enable user selection from between multiple operating modes, at least one of which includes ride control. As another example, ride control options may be automatically enabled based on a set of one or more conditions which are identified, such as determining that a threshold load has been exceeded, the work implement has been positioned in a raised position, a threshold advance speed of the work machine has been exceeded, and/or the like. In various embodiments, ride control options may include a fully automated ride control option wherein ride control features are automatically enabled and implemented, a ride control option in which ride control features are automatically enabled but must be manually implemented, a ride control option in which ride control features must be manually enabled but then may be automatically implemented, etc.

Step 524 as depicted in FIG. 5 relates to the prediction of impacts to follow, based at least in part on the inputs received in steps 512 and 514. In embodiments of the method 500 including a model development stage 510, further wherein the models have been sufficiently developed and validated, such models may be selectively retrievable and applied in step 524 for predicting the impacts.

Figure 6:
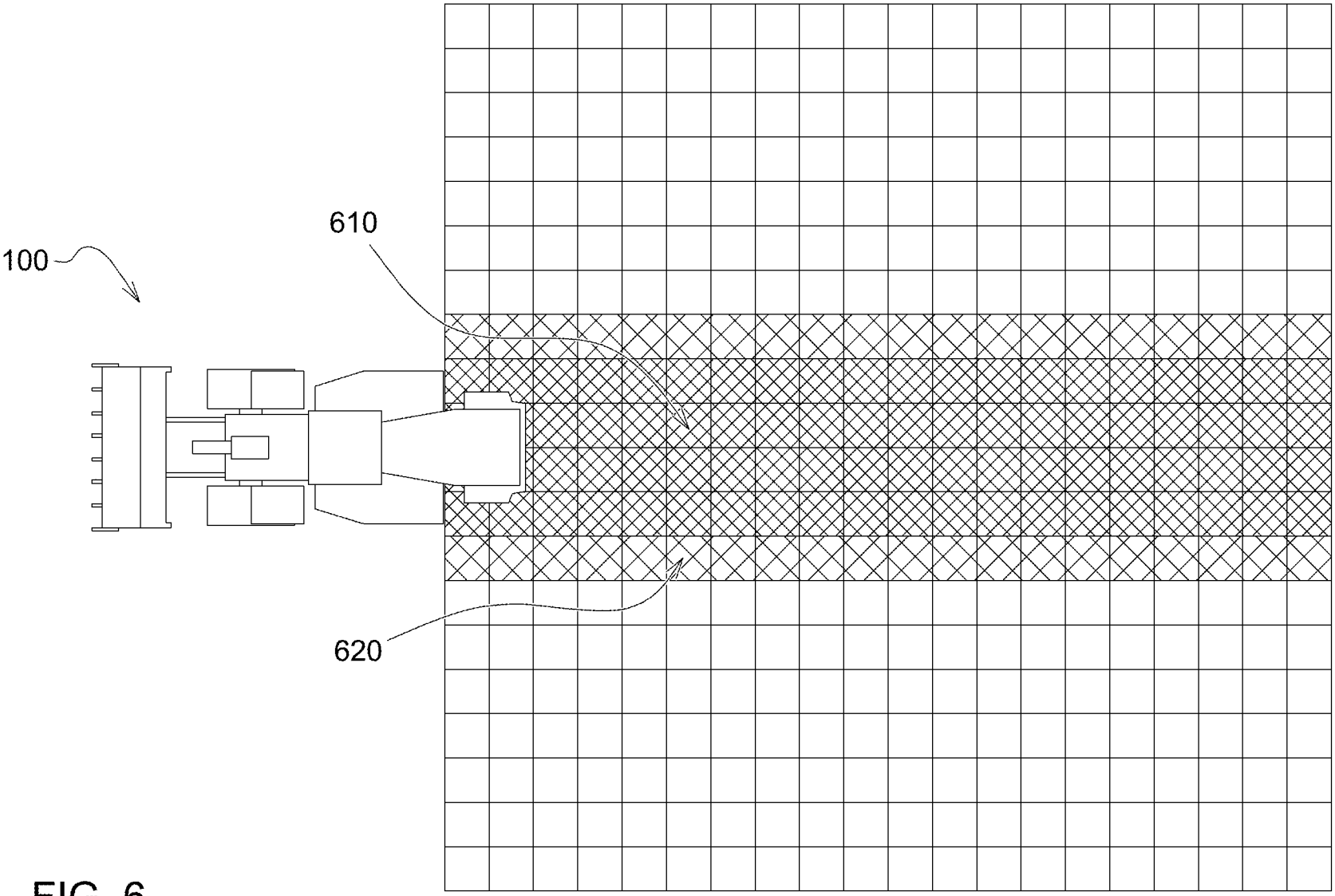
FIG. 6 is an overhead view representing an example of multiple available zones for controlled travel of a work machine of the present disclosure.

In some embodiments, further with illustrative reference to FIG. 6, step 524 may include predicting impacts which will follow if the work machine 100 remains in a current forward path or trajectory 610, and may further predict impacts which would follow if the work machine 100 were to adjust its current forward path or trajectory to instead traverse one or more buffer zones 620 proximate to the current forward path or trajectory 610.

Step 526 as depicted in FIG. 5 relates to a determination as to whether an optimization mode has been selected or otherwise specified. As one example, an optimization mode may be selectable to optimize ride control settings relating to comfort, or in other words to minimize disturbances felt by an operator in the operator cab. Such an optimization mode may for example prioritize input data sets correlated with impacts observed by, or in other words relating to input received from, actual operators. As another example, an optimization mode may be selectable to provide minimal impacts (whether to operator comfort, loads carried by the work machine, or other performance-related metrics) while maintaining at least a minimum required travel speed for the work machine, for example to a specified destination. As yet another example, an optimization mode may be selectable to reduce impacts to at least a minimum allowable level while otherwise maximizing a speed to destination for the work machine.

Step 528 as depicted in FIG. 5 relates to dynamic control of one or more work machine operations, for example via control signals provided from the controller 302 to one or more actuators via steering control unit 324, work implement control unit 326, drive control unit 328, or the like. The dynamic control may be utilized to control the one or more work machine operations in view of the specified optimization mode. In various embodiments, dynamic control may include calculating or otherwise determining a desired flow of hydraulic fluid and/or acceleration to achieve appropriate shock absorbance, and generating control signals to the relevant control units to achieve the desired flow.

While the ride control option remains enabled (i.e., "yes" in response to the query in step 530), the method 500 continues to loop back to step 528 for dynamic control of one or more work machine operations, as may for example further include dynamic reconsideration and adjustment to work machine operation settings based on further inputs as they are received. Alternatively, when the ride control option becomes disabled (i.e., "no" in response to the query in step 530), the method 500 loops back to step 522 until such time as a ride control option becomes enabled again. In various embodiments, the ride control features may be automatically disabled based on certain conditions, such as for example determining that the previously load-carrying work implement has become unloaded, that the work implement has been lowered, that an advance speed of the work machine has reduced below a specified threshold, and/or the like.

Thus it is seen that an apparatus and/or methods according to the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments, unless otherwise specifically stated.

What is claimed is:

1. A computer-implemented method for predictively mitigating the impacts of travel across uneven terrain by a work machine having at least one ground engaging mechanism and at least one implement configured to carry a load and movable across a range of positions relative to a frame of the work machine, the method comprising:

during an iterative model development stage, correlating first input data sets corresponding to one or more terrain characteristics and to one or more work machine operating values with further input data sets corresponding to one or more observed impacts, wherein the one or more work machine operating values comprise a work implement position, wherein the one or more observed impacts comprise a detected vibration and/or a detected change in one or more load characteristics;

during a current operation, receiving input signals from one or more perception sensors corresponding to one or more terrain characteristics in at least a forward direction relative to the work machine, input signals from one or more position sensors corresponding to a current position of the at least one work implement relative to the work machine frame, and input signals from one or more load sensors corresponding to one or more characteristics of a current load being carried by the at least one work implement;

predicting one or more impacts to result from travel across the terrain in the at least forward direction, based on the received input signals during the current operation and the correlated one or more observed impacts as retrieved from the model; and dynamically controlling one or more work machine operating values during travel by the work machine across the terrain based at least on the predicted one or more impacts.

2. The method of claim 1, wherein the dynamically controlled one or more work machine operating values comprise a position of the at least one work implement relative to the frame of the work machine.

3. The method of claim 1, wherein the dynamically controlled one or more work machine operating values comprise a travel speed of the work machine.

4. The method of claim 1, further comprising receiving input signals during the current operation corresponding to a current location of the work machine, and predicting the one or more impacts further based on previously mapped terrain characteristics associated with the current location of the work machine.

5. The method of claim 1, comprising automatically enabling the predicting of the one or more impacts and the dynamically controlling of the one or more work machine operating values based on a determination that a threshold load is exceeded via the one or more characteristics of the current load, and further based on a determination that the work machine is traveling.

6. The method of claim 1, comprising automatically disabling the predicting of the one or more impacts and the dynamically controlling of the one or more work machine operating values based on a determination that the at least one work implement is unloaded, or that the work machine is stopped.

7. The method of claim 1, wherein the one or more characteristics of the current load comprise a total mass, a total volume, and/or a type of material being carried by the at least one work implement.

8. The method of claim 1, comprising, during the current operation, receiving the input signals from the one or more perception sensors further corresponding to one or more terrain characteristics in one or more buffer zones relative to the at least forward direction, and further predicting one or more impacts to result from travel across the terrain via the one or more buffer zones.

9. The method of claim 8, wherein the dynamically controlled one or more work machine operating values during travel by the work machine across the terrain correspond to steering along a selectively modified path of the work machine via at least one of the one or more buffer zones based at least on the predicted one or more impacts.

10. The method of claim 1, wherein the one or more work machine operating values are dynamically controlled to target values set according to a selected optimization mode from a plurality of selectable optimization modes.

11. The method of claim 10, wherein at least one of the plurality of optimization modes is configured to minimize vibration associated with the machine frame responsive to predicted impacts while remaining within a specified range of values for one or more other work conditions.

12. The method of claim 11, wherein at least one of the plurality of optimization modes is configured to maximize values for one or more other work conditions while remaining within a specified range of values for vibration associated with the machine frame.

13. A computer-implemented system for predictively mitigating the impacts of travel across uneven terrain by a work machine having at least one ground engaging mechanism and at least one implement configured to carry a load and movable across a range of positions relative to a frame of the work machine, the system comprising one or more processors configured:

during an iterative model development stage, to correlate first input data sets corresponding to one or more terrain characteristics and to one or more work machine operating values with further input data sets corresponding to one or more observed impacts, wherein the one or more work machine operating values comprise a work implement position, wherein the one or more observed impacts comprise a detected vibration and/or a detected change in one or more load characteristics;

during a current operation, to:

receive input signals from one or more perception sensors corresponding to one or more terrain characteristics in at least a forward direction relative to the work machine, input signals from one or more position sensors corresponding to a current position of the at least one work implement relative to the work machine frame, and input signals from one or more load sensors corresponding to one or more characteristics of a current load being carried by the at least one work implement;

predict one or more impacts to result from travel across the terrain in the at least forward direction, based on the received input signals during the current operation and the correlated one or more observed impacts as retrieved from the model; and dynamically control one or more work machine operating values during travel by the work machine across the terrain based at least on the predicted one or more impacts.

14. The system of claim 13, wherein at least one of the one or more processors comprises a remote server functionally linked to a controller of the work machine comprising another of the one or more processors.

15. The system of claim 13, wherein the dynamically controlled one or more work machine operating values comprise a position of the at least one work implement relative to the frame of the work machine and/or a travel speed of the work machine.

16. The system of claim 13, wherein the one or more processors are further configured to receive input signals during the current operation corresponding to a current location of the work machine, and predict the one or more impacts further based on previously mapped terrain characteristics associated with the current location of the work machine.

17. The system of claim 13, wherein the one or more processors are further configured to automatically enable the predicting of the one or more impacts and the dynamically controlling of the one or more work machine operating values based on a determination that a threshold load is exceeded via the one or more characteristics of the current load, and further based on a determination that the work machine is traveling.

18. The system of claim 13, wherein the one or more processors are further configured to automatically disable the predicting of the one or more impacts and the dynamically controlling of the one or more work machine operating values based on a determination that the at least one work implement is unloaded, or that the work machine is stopped.

19. The system of claim 13, wherein the one or more characteristics of the current load comprise a total mass, a total volume, and/or a type of material being carried by the at least one work implement.

20. The system of claim 13, wherein the one or more processors are further configured to, during the current operation, receive the input signals from the one or more perception sensors further corresponding to one or more terrain characteristics in one or more buffer zones relative to the at least forward direction, and further predict one or more impacts to result from travel across the terrain via the one or more buffer zones, wherein the dynamically controlled one or more work machine operating values during travel by the work machine across the terrain correspond to steering along a selectively modified path of the work machine via at least one of the one or more buffer zones based at least on the predicted one or more impacts.

* * * * *